United States Patent [19]

Muchisky et al.

[11] Patent Number: 4,550,901

[45] Date of Patent: Nov. 5, 1985

[54] PORTABLE ADJUSTABLE BODY TILT BOARD

[76] Inventors: Thomas P. Muchisky, 784 Hawthicket La., Des Peres, Mo. 63131; James V. Young, 35 Benton Pl., St. Louis, Mo. 63104

[21] Appl. No.: 481,840

[22] Filed: Apr. 4, 1983

[51] Int. Cl.[4] ..... A47C 21/00

[52] U.S. Cl. ..... 269/328; 5/443

[58] Field of Search ..... 5/443, 432, 433; 248/450, 460, 542; 269/328, 323, 79, 74

[56] References Cited

U.S. PATENT DOCUMENTS

| | | | |
|---|---|---|---|
| 722,010 | 3/1903 | Glass | 248/454 |
| 1,619,685 | 3/1927 | Updegrove et al. | 5/443 |
| 2,208,945 | 7/1940 | Miller | 5/433 |
| 3,297,118 | 1/1967 | Van Skyhawk et al. | 248/460 |
| 4,000,736 | 1/1977 | Bruscemi | 5/443 |
| 4,118,812 | 10/1978 | Pangburn | 5/433 |
| 4,432,108 | 2/1984 | Chapman | 5/443 |

FOREIGN PATENT DOCUMENTS

| | | | |
|---|---|---|---|
| 758706 | 10/1956 | United Kingdom | 248/542 |

*Primary Examiner*—Robert C. Watson

*Attorney, Agent, or Firm*—Polster, Polster and Lucchesi

[57] ABSTRACT

A portable adjustable body tilt board includes a pair of panel members which are joined along an edge by a hinge and a nylon strap wrapped at least partially around the panel members, one end of the strap being fixed to a panel member and the other end of the strap having Velcro TM fastening material to selectively fasten the strap for various angular orientations between the panels. Once secured, the tilt board may be supported from any surface and used to position a human body for therapy.

12 Claims, 10 Drawing Figures

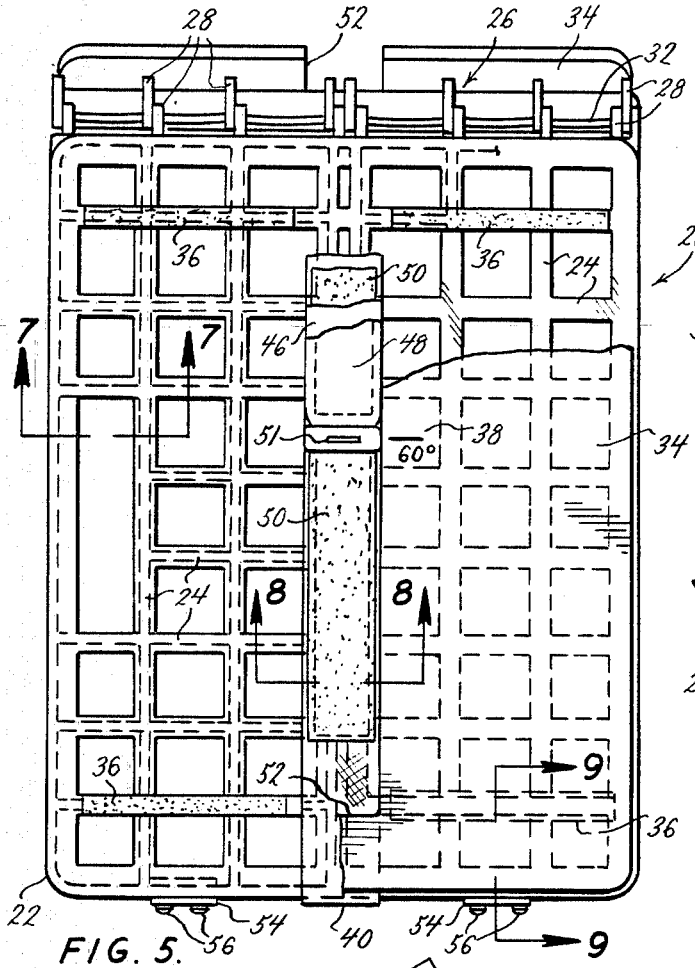
FIG. 5.
FIG. 7.
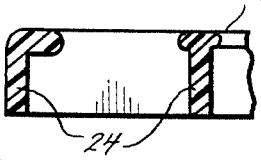
FIG. 8.
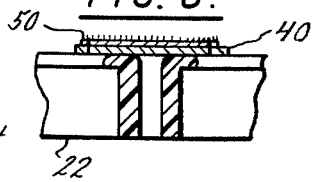
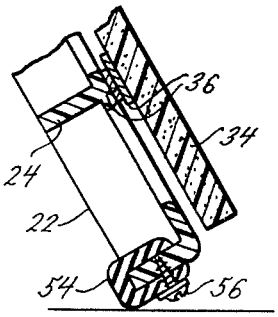
FIG. 9.
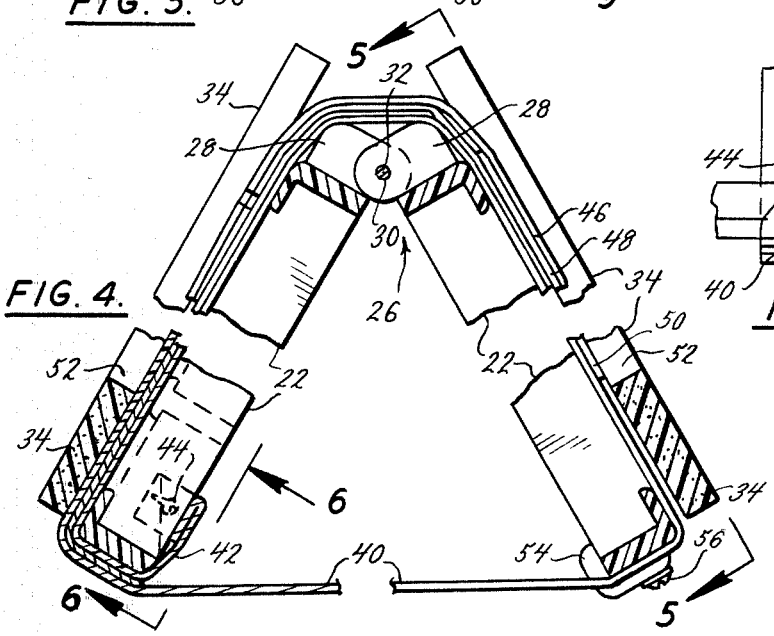
FIG. 4.
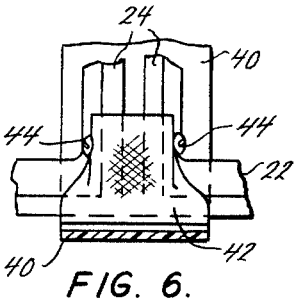
FIG. 6.

PORTABLE ADJUSTABLE BODY TILT BOARD

BACKGROUND AND SUMMARY

Positioning of the body has been found to be a significant factor in the effectiveness of various types of therapy. One of these is in the area of postural drainage which involves the loosening and removal of trapped mucus from the trachiobronchial tree in an oral direction. Careful postitioning of the lungs is necessary so that gravity will help secretions flow from smaller airways into large airways where the secretions can be coughed outward. This can be aided with the use of percussive devices which apply vibrations to the lungs and other bronchial sections in the affected area.

In the prior art, relatively expensive positioning tables are available which have motor driven sections thereof which can be elevated and angled with respect to each other so that a person may lie thereon in various attitudes to achieve the proper body positioning. These devices are generally available only in a medical facility, and are not adapted for home use. Furthermore, these devices are not suitable for self treatment as they require an experienced operator to achieve the proper table position.

The inventors herein have succeeded in developing a portable, adjustable body tilt board which provides the many advantages of the more expensive motorized tilting bed of the prior art, but at much less expense and with unique features making it suitable for use in the clinic, office, or home. The adjustable tilt board generally comprises a pair of panels, each panel having a series of lugs at an edge with holes for the insertion of a rod to hinge the panels together. A cushioning pad is secured to the outer surface of each panel with Velcro TM fasteners, and a nylon strap extending between the panels with a Velcro TM fastener material included in the strap to provide the adjustability required. In the preferred embodiment, one end of the strap is secured to an edge of one of the panels, and the strap is wrapped around each of the panels with a section of Velcro TM fastening material on the free end of the strap which hooks to a mating Velcro TM fastening material secured to a midportion of the strap. A marker is included on the free end of the strap, and a scale is marked along the face of the cushioning pads. The nylon strap is chosen to be of a length such that as the marker is aligned with a number on the scale, e.g. 60°, and the strap secured at that position after which the panels may be pivoted apart and rested on the floor or other supporting surface to achieve an angular orientation of 60° between each panel and the supporting surface. Of course, the angle may be easily adjusted by tearing loose the Velcro TM fastener, repositioning the angular orientation of the panels, and refastening the free end of the strap. A person may then lie on, over, or against one or both of the panels as desired to achieve the proper angular positioning of the body for application of the therapy, such as in percussive postural draining.

The panels may themselves be formed by a plastic injection molding process and be identically the same. The lugs providing the hinge may be suitably positioned such that they nest upon reversal of one panel with respect to the other. An aluminum rod may be inserted through the lug holes, and slightly deformed to hold it in position. The length of the nylon strap is chosen such that it wraps at least once around the edge of the panel where one end of the strap is secured which provides increased strength and relieves the tension from the screws securing the strap to the panel. This greatly minimizes the possibility of the strap tearing loose from the tilt board.

The present invention has been found to be highly stable and able to support bodies weighing up to 250 lbs. (113.25 kg) while maintaining a very small angle, such as 20° between the panel and the supporting surface. This stability is due at least in part to the Velcro TM fastening material which is particularly resistant to the shear forces experienced in the strap as weight is placed on the tilt board. For angles less than 20°, additional straps could be provided.

These and other advantages of the present invention may be more fully understood by referring to the drawings and detailed description of the preferred embodiment which follows.

BRIEF DESCRIPTION OF THE DRAWINGS

FIG. 4 is a cross sectional view taken along the plane of line 4—4 in FIG. 3 and detailing the nylon strap positioning.

FIG. 5 is a top view of one of the panels partially broken away to show the construction thereof.

FIG. 6 is a cross sectional view taken along on the plane of line 6—6 in FIG. 4 and detailing the securing of one end of the strap to a panel.

FIG. 7 is partial cross sectional view taken along the plane of line 7—7 in FIG. 5 and detailing the honeycomb structure of the plastic injection molded panel.

FIG. 8 is a partial cross sectional view taken along the plane of line 8—8 in FIG. 5 and further detailing the honeycomb structure of the plastic panel.

FIG. 9 is a partial cross sectional view taken along the plane of line 9—9 in FIG. 5 and detailing the support feet for each panel and the cushioning pad attachment.

DETAILED DESCRIPTION OF THE PREFERRED EMBODIMENT

Figure 3:
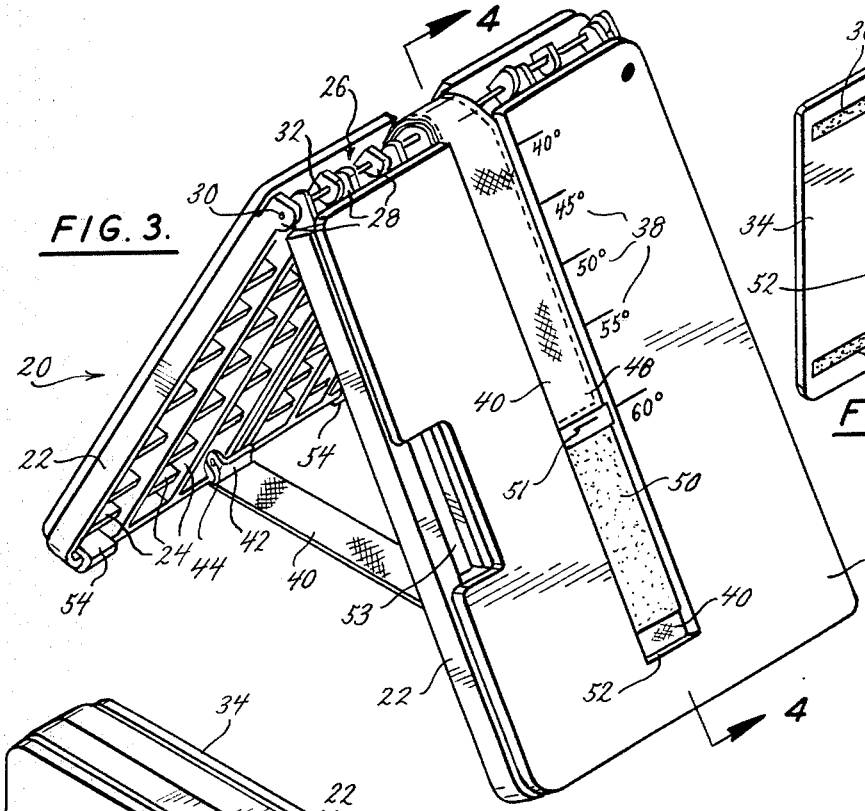
FIG. 3 is an isometric view of the tilt board opened and fixed at an angle of 60°.

The portable adjustable body tilt board 20 includes a pair of panel members 22 which are formed through a plastic injection molded process to include a plurality of ribs 24 as shown in greater detail in FIGS. 3 and 5. Each panel has a hinge section 26 along its upper edge which comprises a plurality of lugs 28 each of which has a hole 30 extending therethrough for the insertion of an aluminum rod 32, the rod being partially deformed between the lugs 28 to prevent its working free.

Figure 10:
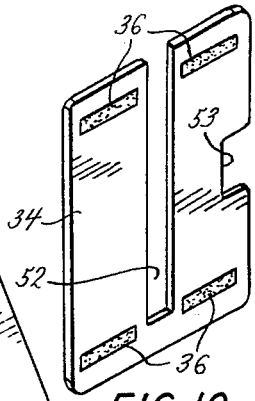
FIG. 10 is an isometric view of a cushioning pad.
Figure 1:
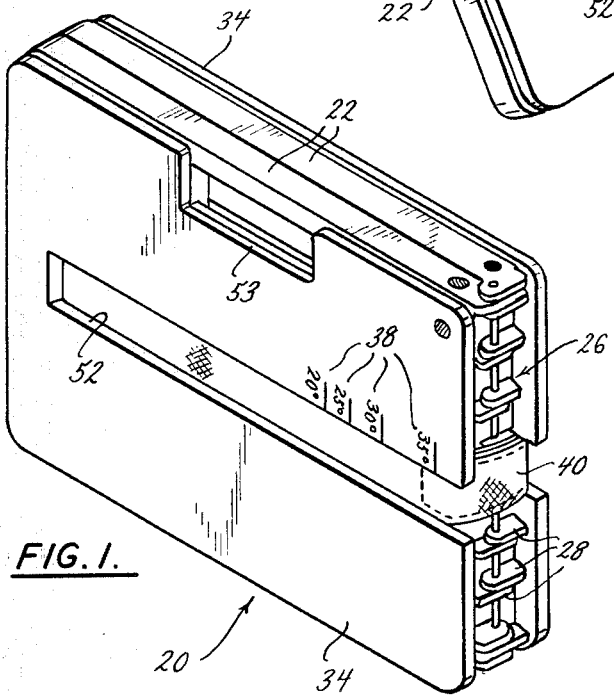
FIG. 1 is an isometric view of the adjustable body tilt board closed into its transportable position.

Each panel member 22 has a cushioning pad 34 with Velcro TM material 36 secured to its backside for releasably fastening the cushioning pads 34 to the panel members 22. As best shown in FIGS. 1 and 3, a scale 38 includes markings for various angles of inclination between each panel member 22 and the supporting surface on which it rests. A nylon strap 40 is fixed at one end 42 by screws 44 or the like to an edge of panel member 22 and wraps around both panel members with its free end 46 having Velcro TM material 48 for fastening to matching Velcro TM material 50 secured to a medial portion of the strap 40. This is best shown in FIGS. 4, 5, and 8. A marker 51 is attached to free end 46 for indicating an angular position on scale 38, as shown in FIG. 3. As shown in FIG. 10, a channel 52 is cut away from cushioning pad 34 to accommodate the passage of nylon strap 40 along the top of panel members 22 without undue interference. Also, a handle cutout 53 may be formed in pad 34 to facilitate carrying of the tilt board 20, as shown in FIG. 1. As shown in FIG. 9, rubber feet 54 may be secured to the bottom of panel members 22 by screws 56 or the like.

Figure 2:
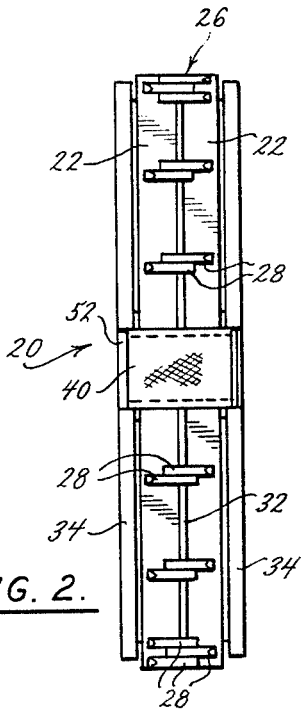
FIG. 2 is a side view of the tilt board detailing the hinge structure.

In use, the portable adjustable body tilt board is stored or transported in the position shown in FIGS. 1 and 2 with the nylon strap wrapped therearound and secured with the Velcro TM fastening material to maintain it in its closed position. When it is desired to be used, the free end of the nylon strap is unfastened by tearing loose the Velcro TM fastening material, pivoting the panel members apart to an angle somewhat greater than desired, fastening the free end of the nylon strap with the Velcro TM fastening material such that the marker is adjacent the indicated angle desired, and then pivoting the panel members completely apart against the restriction of the nylon strap to the indicated position. The adjustable body tilt board may be placed on any supporting surface such as a bed or floor, and used to accurately position a person for therapy. The angle of incline for the panel members may be easily changed by tearing loose the free end of the nylon strap, repositioning the panel members as described above, and then resecuring the nylon strap such that the marker is adjacent the newly desired angle of incline.

Various changes and modifications may be made to the invention as would be apparent to one of ordinary skill in the art. These changes and modifications are included as part of the invention which is intended to be limited only by the scope of the claims appended hereto.

What is claimed is:

1. A portable, adjustable tilt board to at least partially support and position a human body for therapy, comprising:

a pair of panels;

hinge means joining said panels along an edge thereof;

means to selectively fix the angular separation between said panels so that said tilt board may be propped open on a supporting surface with the panels oriented at the selected angle as an aid in supporting and positioning a human body for therapy, said panel fixing means including at least one strap extending between said panels, said strap wrapping at least partially around both of said panels;

means for securing one end of said strap to one of said panels;

means for securing the other end of said strap, said other end strap securing means including means to secure said other end to a medial portion of said strap; and a scale associated with said panel fixing means to indicate the angle formed by each panel with the supporting surface.

2. The tilt board of claim 1 wherein said strap has a marker thereon defining a scale with said panels to indicate the angle formed between each panel and the supporting surface as the strap is secured and the marker is positioned adjacent thereto.

3. The tilt board of claim 2 wherein said panels may be fixed at an angle from between about 20° to about 60° with respect to the supporting surface.

4. A portable, adjustable tilt board to at least partially support and position a human body for therapy, comprising:

a first panel;

a second panel;

hinge means joining said panels along an edge of each thereof;

means to selectively fix the angular separation between said panels so that said tilt board may be propped open on a supporting surface with the panels oriented at the selected angle as an aid in supporting and positioning the human body for therapy, said panel fixing means including a strap, means securing one end of said strap to one of said panels, means for selectively securing the other end of said strap, and means to receive said strap as it is wrapped at least partially around said panels; and removable cushioning pads including means to releasably secure said pads to said panels, said strap receiving means including channels in said pads to receive said strap.

5. The tilt board of claim 4 further comprising a marker on said strap, and a scale on said pads to indicate the angle formed between each of said panels and the supporting surface.

6. The tilt board of claim 5 wherein said strap is secured to the lower end of one panel, and the strap wraps at least partially around both panels including at least once around said securing point.

7. The tilt board of claim 6 wherein the panels are molded plastic, both panels being identical to each other.

8. The tilt board of claim 7 wherein the hinge means includes a plurality of lugs at an end of each panel, each lug having means defining a hole therethrough, said lugs being positioned to nest with those of another panel as it is reversed, and a rod for insertion through said lug holes to join said panels.

9. A portable, adjustable tilt board to at least partially support and position a human body for therapy comprising two panels, hinge means joining said panels along an edge thereof, and means to selectively fix the panels in a preselected angular orientation including a strap, means securing an end of the strap to an edge of one of the panels, said strap wrapped at least partially around both of said panels, and Velcro TM material secured along the free end of the strap and along the back of a medial portion of the strap to selectively secure the free end thereto.

10. The tilt board of claim 9 further comprising removable cushioning pads, means to releasably secure said pads to said panels, a scale marked along said pads, and a marker mounted at the free end of the strap to indicate on the scale the angle formed between each of said panels and the supporting surface.

11. The tilt board of claim 10 wherein the hinge means includes a plurality of lugs at an end of each panel, each lug having means defining a hole therethrough, said lugs being positioned to nest with those of another panel as it is reversed, and a rod for insertion through said lug holes to join said panels.

12. A portable, adjustable tilt board to at least partially support and position a human body for therapy, comprising two panels, means joining said panels for permitting relative movement between said panels in angular relationship with one another, means to fix selectively the panels in any one of a preselected angular orientation with respect to one another including a strap, means securing an end of the strap to one of said panels, said strap being wrapped at least partially around both of said panels, and means to secure the other end of said strap to a medial portion of the strap to secure the free end of said strap to itself.

* * * * *